US011572857B2

(12) United States Patent
Han et al.

(10) Patent No.: US 11,572,857 B2
(45) Date of Patent: Feb. 7, 2023

(54) SUCTION VALVE FOR HIGH-PRESSURE FUEL PUMP

(71) Applicant: HYUNDAI KEFICO CORPORATION, Gunpo-si (KR)

(72) Inventors: Kyung Chul Han, Seoul (KR); Hyeong Kyun Park, Gyeonggi-Do (KR); Jin Sung Kim, Seoul (KR); Chun Ky Hong, Gyeonggi-Do (KR)

(73) Assignee: Hyundai Kefico Corporation, Gyeonggi-Do (KR)

( * ) Notice: Subject to any disclaimer, the term of this patent is extended or adjusted under 35 U.S.C. 154(b) by 155 days.

(21) Appl. No.: 17/116,577

(22) Filed: Dec. 9, 2020

(65) Prior Publication Data

US 2021/0180552 A1 Jun. 17, 2021

(30) Foreign Application Priority Data

Dec. 17, 2019 (KR) ..... 10-2019-0168518

(51) Int. Cl.

| | |
|---|---|
| ***F02M 59/46*** | (2006.01) |
| ***F02M 59/10*** | (2006.01) |
| ***F04B 7/00*** | (2006.01) |
| ***F04B 53/10*** | (2006.01) |

(52) U.S. Cl.

CPC ..... *F02M 59/46* (2013.01); *F02M 59/10* (2013.01); *F04B 7/0003* (2013.01); *F04B 53/10* (2013.01)

(58) Field of Classification Search

CPC ..... F02M 59/46; F02M 59/10; F02M 59/368; F04B 7/0003; F04B 53/10

USPC ..... 251/129.15

See application file for complete search history.

(56) References Cited

U.S. PATENT DOCUMENTS

2013/0327973 A1* 12/2013 Maier ..... F02M 59/366 251/337

FOREIGN PATENT DOCUMENTS

| | | | | |
|---|---|---|---|---|
| CN | 109209714 A | * | 1/2019 | ..... F02M 37/0023 |
| DE | 102010044119 A1 | | 5/2012 | |
| JP | 2014-141896 A | | 8/2014 | |
| KR | 20130126920 A | | 11/2013 | |
| KR | 10-2019-0004665 A | | 1/2019 | |
| KR | 20190032817 A | | 3/2019 | |

* cited by examiner

*Primary Examiner* — Mahmoud Gimie
(74) *Attorney, Agent, or Firm* — Fox Rothschild LLP

(57) ABSTRACT

A suction valve of a high-pressure fuel pump for a vehicle includes a housing having an inlet through which a fuel is introduced and a pump chamber configured to press the fuel, a valve installation space arranged between the inlet and the pump chamber, and a solenoid part provided with a rod for performing a linear reciprocal motion, and further includes a valve sleeve inserted into the valve installation space and formed with a flow hole, a valve spring seated on the valve sleeve, a valve plate elastically supported by the valve spring, and moving in conjunction with the rod, and a valve sheet formed with an introduction hole opened and closed by the valve plate, in which the valve sleeve is slid and inserted into the valve installation space, and the valve sheet is fitted into and fastened to the valve installation space to support the valve sleeve.

6 Claims, 7 Drawing Sheets

SUCTION VALVE FOR HIGH-PRESSURE FUEL PUMP

CROSS-REFERENCE(S) TO RELATED APPLICATION(S)

This application claims under 35 U.S.C. § 119 the benefit of Korean Patent Application No. 10-2019-0168518 filed on Dec. 17, 2019, the entire contents of which are incorporated herein by reference.

BACKGROUND

(a) Technical Field

The present disclosure relates to a suction valve of a high-pressure fuel pump for a vehicle, more particularly, to the suction valve of the high-pressure fuel pump, which can prevent deformation of a valve sleeve, and also can prevent the suction valve from being closed by the fuel which backflows from a pump chamber side.

(b) Description of the Related Art

A fuel supply device for a vehicle includes a fuel tank, a fuel rail, and a fuel pump. The fuel rail serves to distribute a high-pressure fuel stored in the fuel tank to each injector. The fuel rail is installed with a plurality of injectors, and each injector is connected to a cylinder head or an intake manifold to inject the fuel into a combustion chamber or a port.

The fuel is supplied from the fuel tank at a low pressure. A high-pressure fuel pump is provided between the fuel rail and the fuel tank, and the high-pressure fuel pump compresses the fuel at a high pressure to transfer the high-pressure fuel to the fuel rail.

That is, as illustrated in FIG. 1 (RELATED ART), the high-pressure fuel pump has an inlet and a discharge port 11 formed in a housing 10, and a piston 30 presses and compresses the fuel introduced into the inlet at a high pressure.

Further, a suction valve 20, which is a flow control valve, is installed on the flow path from the inlet to the discharge port 11, and configured to control the flow of the fuel.

The suction valve 20 separately illustrated in FIG. 2 (RELATED ART) includes a valve body 21 formed with a hollow hole 21*a* through which the fuel is introduced, and controls the flow discharged through the opening and closing operation of the flow path in the inner space of the valve body 21.

A rod 22 is disposed inside the valve body 21 in the longitudinal direction of the suction valve, and a valve plate 23 is configured to be moved with the rod 22 to open and close the fuel movement passage between the hollow hole 21*a* and the inner space of the valve body 21.

Further, an amateur 24 is connected to the rod 22, and a valve housing 25 connected to the valve body 21 is configured to surround the amateur 24.

Further, a pole core 26 is connected to one side of the valve body 21, and a return spring 27 is provided on the same axis as that of the rod 22 inside the pole core 26.

Therefore, when a current is applied to the pole core 26, the rod 22 is moved toward the pole core 26 to block the flow path from the hollow hole 21*a* to the inner space of the valve body 21, and when the current is not applied, the rod 22 returns to the original location by the return spring 27 to be operated such that the flow path is opened.

Further, a valve sleeve 28 formed with an outflow hole is provided on one side of the valve plate 23, and a valve spring 29 is provided between the valve sleeve 28 and the valve plate 23, thereby allowing the fuel to flow out through the outflow hole from the inner space of the valve body 21, and the valve plate 23 to remain in place.

Further, the valve sleeve 28 allows the valve plate 23 to remain in place to maintain a valve lift, which is an operation distance of the valve plate 23, at a preset interval.

At this time, the valve sleeve 28 is press-fitted into the valve body 21, and the valve body 21 in which the valve sleeve 28 is assembled is press-fitted into the housing 10 to be assembled.

However, there is a problem in that the valve sleeve 28 is deformed every time it is press-fitted, and the valve lift is also changed by a double press-fitting structure which is press-fitted once when the valve sleeve 28 is press-fitted into the valve body 21, and press-fitted once again when the valve body 21 is press-fitted into the housing 10.

As described above, there is a problem in that when the valve lift is changed, the operation speed of the valve is reduced, and when the operation speed is reduced, a discharge flow distribution between products occurs as an amount of fuel charged in the high-pressure chamber is unevenly controlled.

Further, if the flow required by an engine is a small amount of flow or the required amount does not exist in the situation such as a low load or a fuel cut, the high-pressure fuel pump does not discharge the fuel to the fuel rail, and at this time, the operation of the suction valve is unnecessary, such that an electronic control unit (ECU) does not transmit an operation signal, but instead, a phenomenon may occur in which inner fuel backflows due to a piston motion of the high-pressure fuel pump.

FIG. 3 (RELATED ART) illustrates the flow of the fuel, and if a force pushing the valve plate 23 by a flow force generated by the backflow is larger than a force of the return spring 27, the suction valve is self-closed.

When such a phenomenon occurs, there are problems in that the pressure of the fuel rail is not controlled because the discharged flow is not controlled, and the high-pressure fuel pump discharges the compressed fuel to the fuel rail although it is not controlled.

However, if the return spring with a large force is used, there are problems in that it is not economical and the operation noise is also increased.

SUMMARY

The present disclosure provides a suction valve of a high-pressure fuel pump, which can prevent deformation by removing a double press-fitting structure of a valve sleeve, and allows the valve sleeve to be assembled with a preset valve lift to reduce a discharge flow distribution between products.

Further, another object of the present disclosure is to provide a suction valve of a high-pressure fuel pump which may prevent self-closing due to backflow of an inner fuel.

The object of the present disclosure is not limited thereto, and other objects not mentioned will be clearly understood by those skilled in the art from the following description.

The present disclosure provides a suction valve of a high-pressure fuel pump, the suction valve including: a housing having a hollow hole through which a fuel is introduced and a pump chamber configured to press the fuel, a valve installation space arranged between the hollow hole and the pump chamber, and a solenoid part provided with a rod for performing a linear reciprocal motion, a valve sleeve inserted into the valve installation space and formed with a flow hole, a valve spring seated on the valve sleeve, a valve plate elastically supported by the valve spring, and moving in conjunction with the rod, and a valve sheet formed with an introduction hole opened and closed by the valve plate, in which the valve sleeve is slid and inserted into the valve installation space, and the valve sheet is fitted into and fastened to the valve installation space to support the valve sleeve to fix a location of the valve sleeve.

Preferably, the valve sleeve includes: a support part having a fixed location between a seating part formed to protrude inward from the valve installation space and the valve sheet, a guide part provided inside the support part, having a guide groove formed to be recessed on a surface of the guide part facing the valve sheet, into which the valve spring and the valve plate are inserted, and guiding the outside of the valve plate, and a connection part connecting the support part to the guide part, and formed with the flow hole.

At this time, the valve sleeve has a surface of the support part facing the valve sheet and the surface of the guide part facing the valve sheet formed to be stepped such that the guide part is spaced apart from the valve sheet.

Further, the guide part includes: a stopper formed to protrude from a surface of the guide groove facing the valve plate and supported by a protrusion formed to protrude from the valve plate when the valve plate is opened.

Further, the valve sheet includes: a deformation prevention groove formed to be recessed on a surface facing the valve sleeve.

Further, the valve sleeve has a plurality of flow holes, and the flow holes are provided to be spaced apart from each other at regular intervals in a circumferential direction.

Further, the valve installation space includes: a caulking part formed to protrude from inside of the valve installation space to fix the valve sheet.

The present disclosure removes the double press-fitting assembling of the conventional valve sleeve and slides and inserts the valve sleeve to be assembled, thereby preventing the deformation of the valve sleeve and reducing the discharge flow distribution between the products.

Further, it is possible to prevent the valve plate from moving toward the valve sheet when the fuel backflows from the pump chamber side, thereby accurately controlling the discharged flow of the high-pressure pump, and accurately controlling the pressure of the fuel rail.

BRIEF DESCRIPTION OF THE DRAWINGS

The accompanying drawings, which are included to provide a further understanding of the disclosure and are incorporated in and constitute a part of this specification, illustrate embodiments of the disclosure and together with the description serve to explain the principles of the disclosure. In the drawings.

DESCRIPTION OF SPECIFIC EMBODIMENTS

Figure 1:
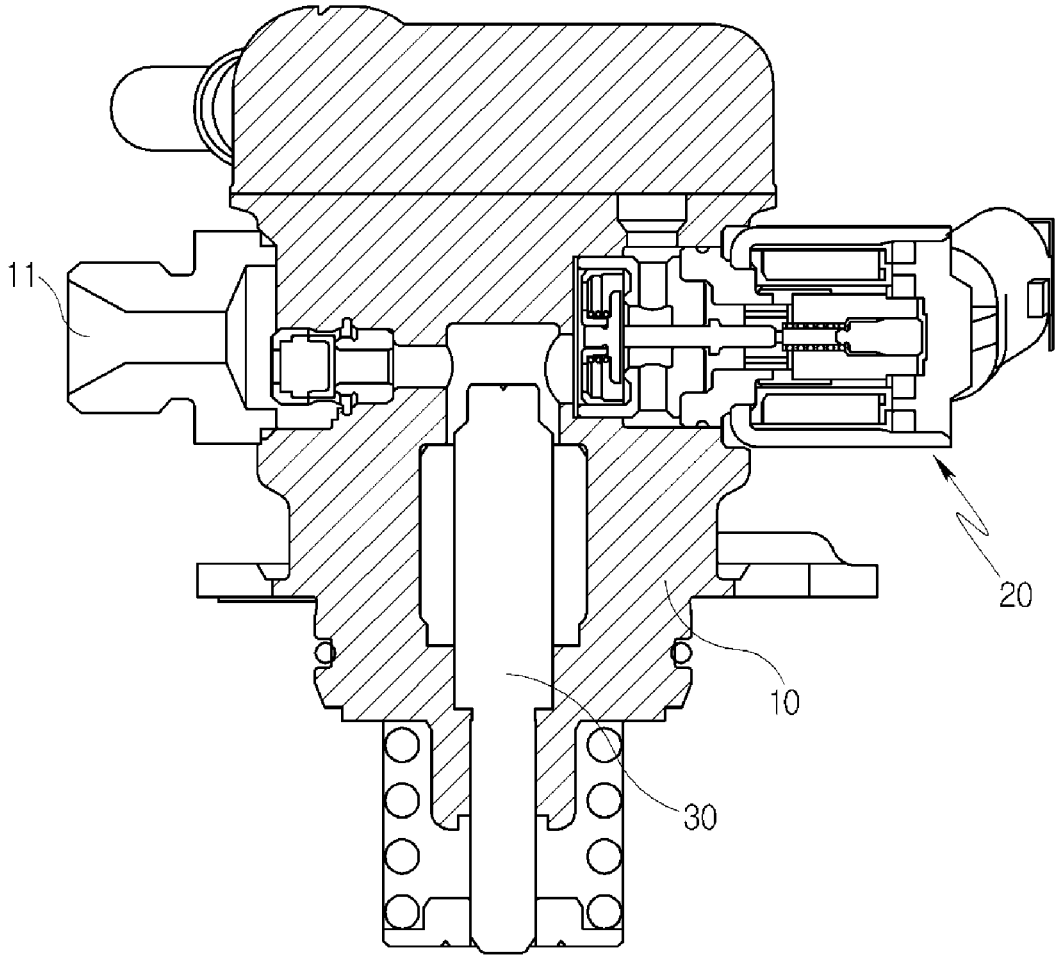
FIG. 1 (RELATED ART)
FIG. 1 (RELATED ART) is a schematic diagram schematically illustrating a conventional high-pressure fuel pump.
Figure 2:
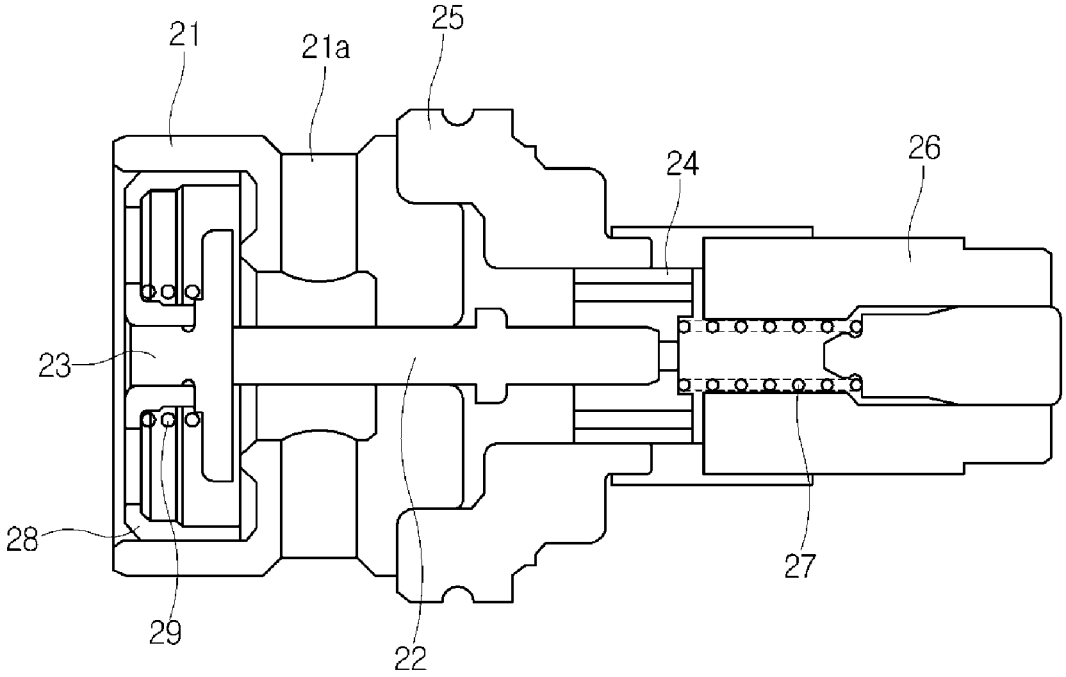
FIG. 2 (RELATED ART)
FIG. 2 (RELATED ART) is a diagram illustrating a suction valve applied to the conventional high-pressure fuel pump.
Figure 3:
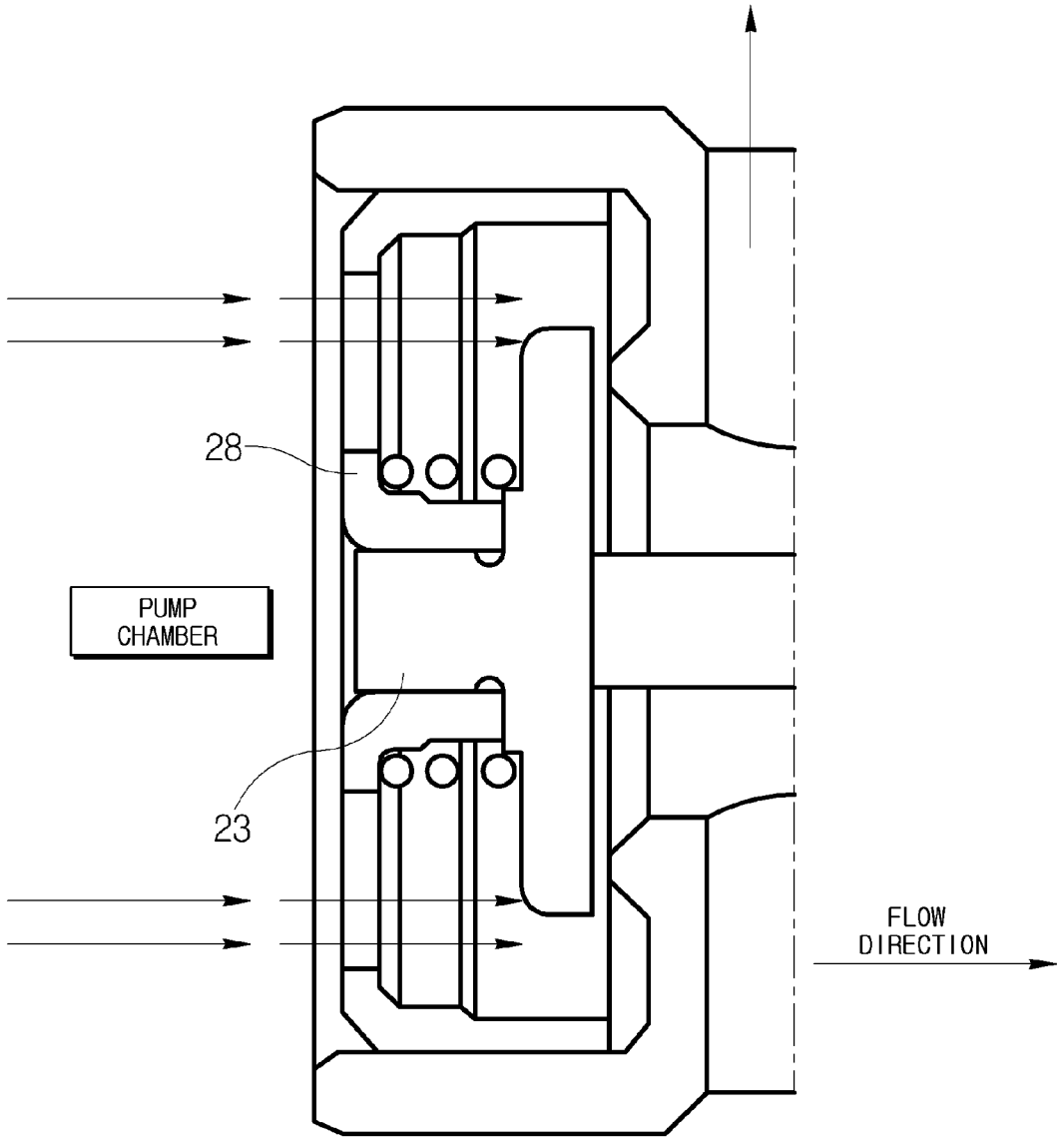
FIG. 3 (RELATED ART)
FIG. 3 (RELATED ART) is a diagram illustrating the flow of the fuel by the suction valve illustrated in FIG. 2 when the fuel backflows.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

Further, the control logic of the present disclosure may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

Hereinafter, some exemplary embodiments of the present disclosure will be described in detail with reference to the exemplary drawings. In adding reference numerals to the components in each drawing, it should be noted that the same components have the same reference numerals as possible even if they are illustrated in different drawings.

Further, in describing the present disclosure, the detailed description thereof will be omitted if it is determined that the specific description for related known configurations or functions may obscure the gist of the present disclosure.

Figure 4:
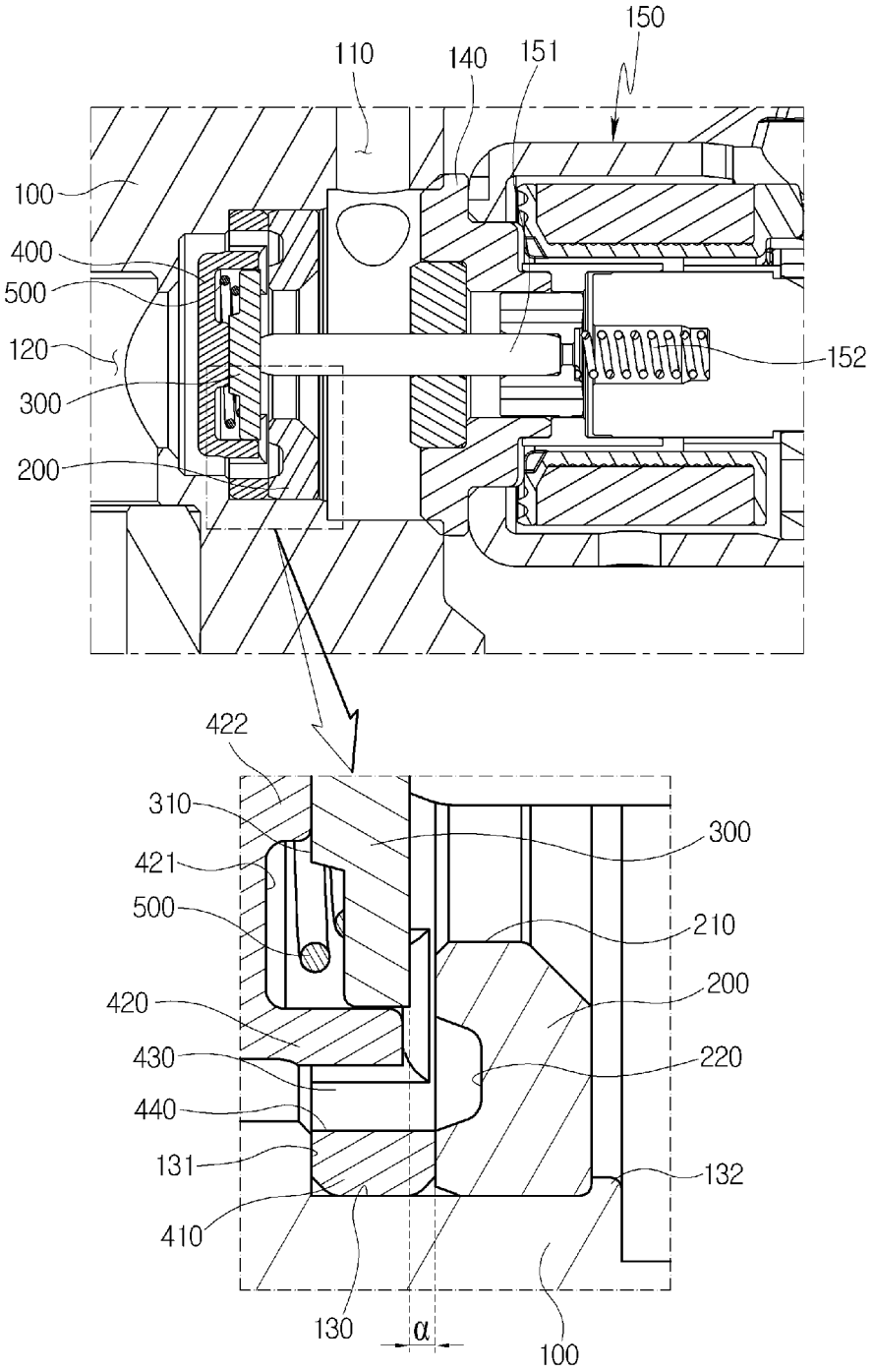
FIG. 4 is a cross-sectional diagram of a suction valve of a high-pressure fuel pump installed with a suction valve according to an exemplary embodiment of the present disclosure.
Figure 5A:
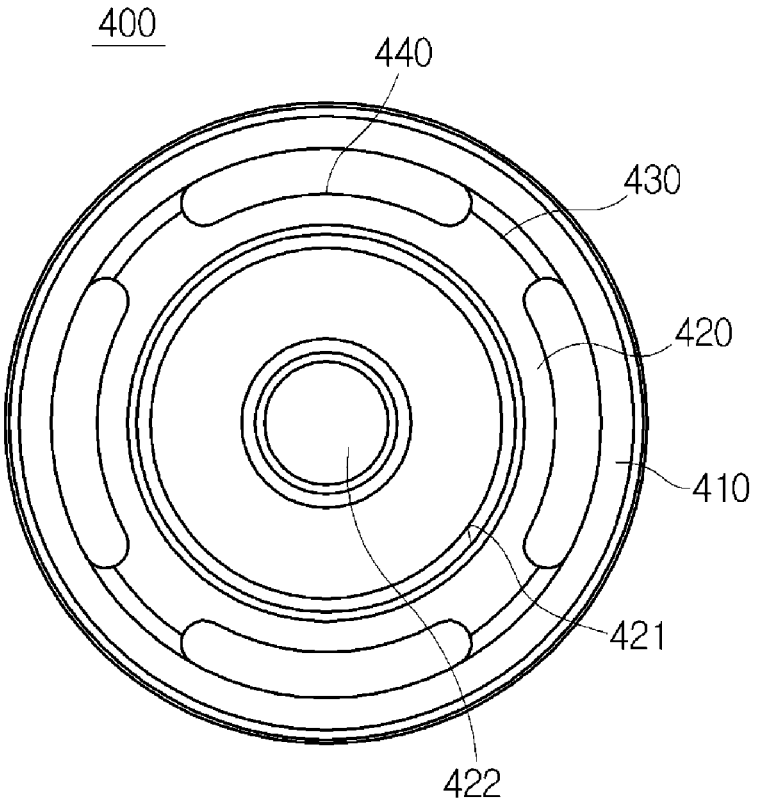
FIGS. 5A and 5B are perspective diagrams of a valve sleeve of the suction valve of the high-pressure fuel pump according to the exemplary embodiment of the present disclosure.
Figure 5B:
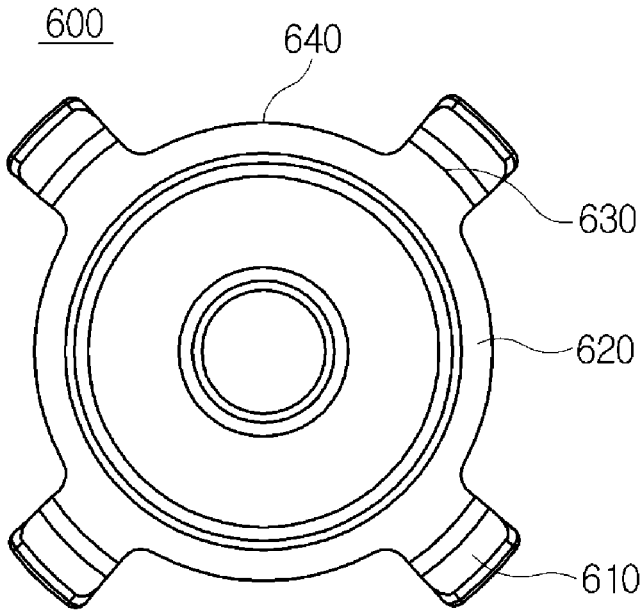
Figure 6:
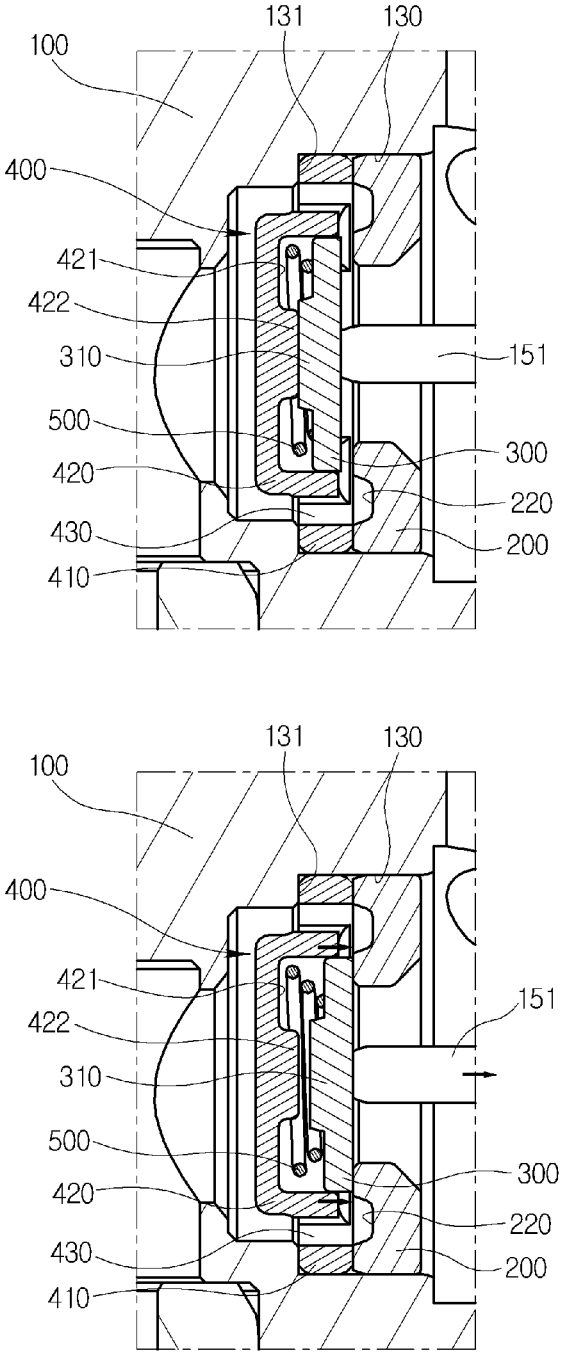
FIG. 6 is an enlarged diagram of a portion A illustrated in FIG. 4 illustrating the operation of the suction valve of the high-pressure fuel pump according to the exemplary embodiment of the present disclosure.

FIG. 4 is a cross-sectional diagram of a suction valve of a high-pressure fuel pump installed with a suction valve according to an exemplary embodiment of the present disclosure, FIGS. 5A and 5B are perspective diagrams of a valve sleeve of the suction valve of the high-pressure fuel pump according to the exemplary embodiment of the present disclosure, and FIG. 6 is an enlarged diagram of a portion A illustrated in FIG. 4 illustrating the operation of the suction valve of the high-pressure fuel pump according to the exemplary embodiment of the present disclosure.

As illustrated in FIGS. 4 to 6, a suction valve of a high-pressure fuel pump according to an exemplary embodiment of the present disclosure includes a housing 100 having an inlet 110 through which a fuel is introduced and a pump chamber 120 pressing the fuel, a valve installation space 130 arranged between the inlet 110 and the pump chamber 120, and a solenoid part 150 provided with a rod 151 for performing a linear reciprocal motion, where the high-pressure fuel pump further includes: a valve sleeve 400 inserted into the valve installation space 130 and formed with a flow hole 440, a valve spring 500 seated on the valve sleeve 400, a valve plate 300 elastically supported by the valve spring 500 and moving in conjunction with the rod 151, and a valve sheet 200 formed with an introduction hole 210 opened and closed by the valve plate 300, in which the valve sleeve 400 is slid and inserted into the valve installation space 130, and the valve sheet 200 is fitted into and fastened to the valve installation space 130 to support the valve sleeve 400 to fix the location of the valve sleeve 400.

Further, in the detailed description of the present disclosure to be descried later, a direction will be described by designating the valve sheet 200 of the valve plate 300 as a front, and an opposite direction thereof as a rear for convenience of explanation, unless otherwise mentioned.

The suction valve, which is preferably a flow control valve (FCV) configuring the high-pressure fuel pump according to the present disclosure, is a device provided on the high-pressure fuel pump, which is provided between a fuel tank and a fuel rail to supply the fuel at a high pressure, to control the flow path of the fuel.

To this end, the suction valve couples a valve housing 140 to the housing 100 of the high-pressure pump, and is installed on the flow path of the suction side of the high-pressure fuel pump.

The housing 100 of the high-pressure fuel pump is provided with the inlet 110 through which the fuel is introduced, the pump chamber 120 pressing the introduced fuel to make a high-pressure fuel, and a discharge port 11 (see FIG. 1) discharging the high-pressure fuel.

Further, the valve installation space 130 installed with the suction valve is provided between the inlet 110 and the pump chamber 120.

Further, the valve housing 140 is provided with the solenoid part 150 to move the valve plate 300, as will be described later.

The solenoid part 150 is provided with the rod 151 for performing the linear reciprocal motion according to the current application or the release of the current application, and a return spring 152 returning the rod 151 to the original location when the current application is released.

The rod 151 moves forward while compressing the return spring 152 when the current is applied to the solenoid part 150, and moves rearward by the return spring 152 when the current application to the solenoid 150 is released.

Further, the suction valve is composed of the valve sleeve 400, the valve spring 500, the valve plate 300, and the valve sheet 200.

The housing 100 has the valve sleeve 400 seated on a seating part 131.

The seating part 131 is stepped in the valve installation space 130 and formed to protrude inward.

The valve sleeve 400 is slid and inserted into the valve installation space 130 of the housing 100 to be seated on the seating part 131, and the location of the valve sleeve 400 is fixed by the valve sheet 200 fixed to the valve installation space 130.

The valve sleeve 400 is formed with the flow hole 440 to discharge the fuel passing between the valve sheet 200 and the valve plate 300 to the pump chamber 120.

Further, the valve sleeve 400 is formed to surround the outside of the valve plate 300 to guide the movement of the valve plate 300.

The valve plate 300 moves in conjunction with the rod 151, and opens and closes the introduction hole 210 of the valve sheet 200 to be described later.

The valve spring 500 is seated on the valve sleeve 400 to elastically support between the valve sleeve 400 and the valve plate 300.

Particularly, the valve spring 500 elastically supports the valve plate 300 to move forward in conjunction with the rod 151 when the rod 151 moves forward.

The valve spring 500 provides an elastic force to the valve plate 300, but provides an elastic force smaller than that of the return spring 152 of the solenoid part 150. That is, if the rod 151 moves forward to remove the force supporting the valve plate 300 rearward, the valve spring 500 provides an elastic force such that the valve plate 300 may also move forward, such that the valve plate 300 is moved in conjunction with the rod 151.

The valve sheet 200 is formed with the introduction hole 210 opened and closed by the valve plate 300, and fitted and inserted so as to be fitted into and fastened to the valve installation space 130 and then the housing 100 is caulked and fastened thereto.

The introduction hole 210 forms the flow path of the fuel together with the flow hole 440.

That is, the valve sleeve 400 is slid and inserted into the valve installation space 130 and supported by the valve sheet 200 having a rear surface seated on the seating part 131, and a front surface fitted and inserted into the valve installation space 130.

Further, the location of the valve sheet 200 is fixed in the state of supporting the valve sleeve 400 by a caulking part 132 formed by caulking the housing 100.

Therefore, the present disclosure may assemble the valve sleeve 400 in the valve installation space 130 without applying force and prevent the deformation due to the conventional double press-fitting assembling.

Therefore, a valve lift ($\alpha$), which is an operation distance of the valve plate 300, may be assembled at a preset distance, thereby preventing the operation speed of the suction valve from being reduced.

Further, it is possible to evenly control an amount of fuel charged in the pump chamber 120 side, thereby reducing the discharge flow distribution between the products.

The valve sleeve 400 is composed of a support part 410 inserted into the valve installation space 130, a guide part 420 guiding the valve plate 300, and a connection part 430 connecting the support part 410 to the guide part 420.

The location of the support part 410 is fixed between the seating part 131 formed to protrude inward from the valve installation space 130 and the valve sheet 200.

The guide part 420 is provided inside the support part 410, has a guide groove 421 formed to be recessed on a surface of the guide part 420 facing the valve sheet 200, into which the valve spring 500 and the valve plate 300 are inserted, and guides the outside of the valve plate 300.

Here, a surface of the support part 410 facing the valve sheet 200 and the surface of the guide part 420 facing the valve sheet 200 are formed to be stepped such that the guide part 420 is spaced apart from the valve sheet 200 to provide the valve lift (a).

Further, the guide part 420 is formed to surround the outside of the valve plate 300 such that the valve plate 300 is not moved to the valve sheet 200 by the fuel which backflows from the pump chamber 120 side while guiding the movement of the valve plate 300. That is, the guide part 420 is formed to surround the outside of the valve plate 300 such that the valve is not closed.

The valve plate 300 moves rearward to be inserted into the guide groove 421 of the guide part 420, and has the entire outer circumferential surface surrounded by the guide part 420, such that the valve plate 300 does not move toward the valve sheet 200 by the fuel which backflows from the pump chamber 120 side.

That is, since the valve plate 300 moves rearward to be inserted into the guide groove 421, the outside and the rear surface of the valve plate 300 are surrounded by the guide part 420 of the valve sleeve 400.

Therefore, the valve plate 300 is not in contact with the fuel which backflows from the pump chamber 120 side, and only the front surface thereof is in contact with the fuel which backflows from the pump chamber 120.

Therefore, the fuel which backflows from the pump chamber 120 side may not apply a force moving the fuel toward the valve sheet 200 to the valve plate 300.

Further, the valve plate 300 is formed to be thicker than the valve lift (α), thereby preventing the valve plate 300 from being separated from the guide groove 421 of the guide part 420 even if the valve plate 300 moves forward.

The support part 410 and the guide part 420 are connected by the connection part 430, and the flow hole 440 is formed.

At this time, a plurality of flow holes 440 are formed, and formed to be spaced apart from each other at regular intervals in the circumferential direction, thereby improving the flow efficiency of the fuel.

The flow holes 440 are formed to be spaced apart from each other at regular intervals in the circumferential direction, and may be formed on only the connection part 430, or formed by cutting the support part 410 and the connection part 430.

Referring to FIGS. 5A and 5B, as illustrated in FIG. 5A, the valve sleeve 400 has the flow holes 440 which may be formed in a shape of the arc long hole in only the connection part 430, spaced apart from each other at regular intervals in the circumferential direction, and formed in four places.

However, the number of flow holes 440 is not limited thereto, and one or two or more may also be formed.

Further, as illustrated in FIG. 5B, the valve sleeve 400 has the flow holes 440 which may be formed by cutting parts of the support part 410 and the connection part 430, and likewise, spaced apart from each other at regular intervals in the circumferential direction and formed in four places, but are not limited thereto.

In this case, a remaining portion of the support part 410 after being cut is slid and inserted to be located between the seating part 131 and the valve sheet 200, and supported by the valve sheet 200, such that the location of the support part 410 is fixed.

Further, the fuel introduced through the introduction hole 210 flows between the valve sheet 200 and the valve plate 300, and then passes through the flow hole 440, which is the space between the guide part 420 and the housing 100, to flow to the pump chamber 120.

Further, the valve plate 300 is provided with a protrusion 310 formed to protrude rearward.

The guide part 420 is provide with a stopper 422 formed to protrude from the surface of the guide groove 421 facing the valve plate 300.

Further, the stopper 422 is supported by the protrusion 310 when the valve plate 300 is opened.

The protrusion 310 and the stopper 422 restrict the movement distance of the rear side of the valve plate 300, thereby enhancing the responsiveness of the suction valve, and enhancing the valve efficiency.

Further, the valve lift (α) is the operation distance of the valve plate 300, and the distance between the front surface of the valve plate 300 in the state where the protrusion 310 is in contact with the stopper 422 and the rear surface of the valve sheet 200.

At this time, the valve sheet 200 has a deformation prevention groove 220 formed to be recessed on the surface facing the valve sleeve 400, in order to prevent the valve sheet 200 from being deformed when being press-fitted into the valve installation space 130 of the housing 100. Therefore, the valve sheet 200 may maintain the valve lift (α) with the valve plate 300.

That is, the deformation prevention groove 220 is formed on the rear surface of the valve sheet 200, which is in contact with the valve plate 300 to maintain the airtightness, to absorb impact when the valve sheet 200 is press-fitted or caulked into the valve installation space 130 of the housing 100.

Further, the deformation prevention groove 220 prevents the deformation of the valve sheet 200, and particularly, prevents the deformation of the introduction hole 210 of the valve sheet 200 and the surface of the rear surface which is in contact with the valve plate 300.

At the same time, the deformation prevention groove 220 is provided at the point at which the flow of the fuel flowing from the inlet 110 to the pump chamber 120 rapidly turns to serve to guide the flow, and reduces the loss of a flow coefficient and enhances the charging efficiency.

Describing the operation structure of the suction valve with reference to FIG. 6, as illustrated in the top of FIG. 6, if the current application is released, the solenoid part 150 has the rod 151 protruding rearward by the return spring 152. Further, the valve plate 300 together with the rod 151 also moves rearward while compressing the valve spring 500.

At this time, the valve plate 300 and the valve sheet 200 are spaced apart from each other at the interval of the preset valve lift (α).

Therefore, the fuel flows into the housing 100 through the inlet 110 of the housing 100, and the fuel inside the housing 100 may flow to the pump chamber 120 through the opened introduction hole 210, the valve lift (α), and the flow hole 440.

Further, as illustrated in the bottom of FIG. 6, if the current is applied to the solenoid part 150, the rod 151 moves forward while compressing the return spring 152. Further, the valve plate 300 also moves forward in conjunction with the rod 151 by the valve spring 500.

The valve plate 300 moves forward to close the introduction hole 210 of the valve sheet 200, and the pump chamber 120 is sealed to press the fuel by a plunger of the high-pressure pump and then discharge the fuel to the fuel rail through the discharge port.

The exemplary embodiments of the present disclosure having the aforementioned shapes and structures remove the double press-fitting assembling of the conventional valve sleeve and slide and insert the valve sleeve to be assembled, thereby preventing the deformation of the valve sleeve and reducing the discharge flow distribution between the products.

Further, it is possible to prevent the valve plate from moving toward the valve sheet when the fuel backflows from the pump chamber side, thereby accurately controlling the discharged flow of the high-pressure pump, and accurately controlling the pressure of the fuel rail as well.

As described above, although it has been described that all components configuring the exemplary embodiment of the present disclosure are coupled to one or coupled and operated, the present disclosure is not necessarily limited to the exemplary embodiment. That is, one or more of all components may also be selectively coupled and operated without departing from the scope of the present disclosure.

The aforementioned description merely and exemplarily explains the technical spirit of the present disclosure, and various modifications and changes may be made by those skilled in the art to which the present disclosure pertains without departing the essential characteristics of the present disclosure. Therefore, the exemplary embodiments disclosed in the present disclosure are intended to describe rather than limiting the technical spirit of the present disclosure, and the scope of the technical spirit of the present disclosure is not limited by the exemplary embodiments. The scope of the present disclosure should be interpreted by the appended claims, and all technical spirits within the scope equivalent thereto should be interpreted as being included in the scope of the present disclosure.

What is claimed is:

1. A suction valve of a high-pressure fuel pump, the suction valve comprising:

a housing having an inlet through which a fuel is introduced and a pump chamber configured to press the fuel, a valve installation space arranged between the inlet and the pump chamber, and a solenoid part provided with a rod for performing a linear reciprocal motion;

a valve sleeve inserted into the valve installation space and formed with a flow hole;

a valve spring seated on the valve sleeve;

a valve plate elastically supported by the valve spring, and moving in conjunction with the rod; and a valve sheet formed with an introduction hole opened and closed by the valve plate, wherein the valve sleeve is slid and inserted into the valve installation space, and wherein the valve sheet is fitted into and fastened to the valve installation space to support the valve sleeve to fix a location of the valve sleeve;

wherein the valve sheet comprises:

a deformation prevention groove formed to be recessed on a surface facing the valve sleeve.

2. The suction valve of claim 1, wherein the valve sleeve comprises:

a support part having a fixed location between a seating part formed to protrude inward from the valve installation space and the valve sheet;

a guide part provided inside the support part, having a guide groove formed to be recessed on a surface of the guide part facing the valve sheet, into which the valve spring and the valve plate are inserted, and guiding the outside of the valve plate; and a connection part connecting the support part to the guide part, and formed with the flow hole.

3. The suction valve of claim 2, wherein the valve sleeve has a surface of the support part facing the valve sheet and the surface of the guide part facing the valve sheet formed to be stepped such that the guide part is spaced apart from the valve sheet.

4. The suction valve of claim 2, wherein the guide part comprises:

a stopper formed to protrude from a surface of the guide groove facing the valve plate and supported by a protrusion formed to protrude from the valve plate when the valve plate is opened.

5. A suction valve of a high-pressure fuel pump, the suction valve comprising:

a housing having an inlet through which a fuel is introduced and a pump chamber configured to press the fuel, a valve installation space arranged between the inlet and the pump chamber, and a solenoid part provided with a rod for performing a linear reciprocal motion;

a valve sleeve inserted into the valve installation space and formed with a flow hole;

a valve spring seated on the valve sleeve;

a valve plate elastically supported by the valve spring, and moving in conjunction with the rod; and a valve sheet formed with an introduction hole opened and closed by the valve plate, wherein the valve sleeve is slid and inserted into the valve installation space, and wherein the valve sheet is fitted into and fastened to the valve installation space to support the valve sleeve to fix a location of the valve sleeve;

wherein the valve sleeve has a plurality of flow holes, and the flow holes are provided to be spaced apart from each other at regular intervals in a circumferential direction.

6. A suction valve of a high-pressure fuel pump, the suction valve comprising:

a housing having an inlet through which a fuel is introduced and a pump chamber configured to press the fuel, a valve installation space arranged between the inlet and the pump chamber, and a solenoid part provided with a rod for performing a linear reciprocal motion;

a valve sleeve inserted into the valve installation space and formed with a flow hole;

a valve spring seated on the valve sleeve;

a valve plate elastically supported by the valve spring, and moving in conjunction with the rod; and a valve sheet formed with an introduction hole opened and closed by the valve plate, wherein the valve sleeve is slid and inserted into the valve installation space, and wherein the valve sheet is fitted into and fastened to the valve installation space to support the valve sleeve to fix a location of the valve sleeve;

wherein the valve installation space comprises:

a caulking part formed to protrude from inside of the valve installation space to fix the valve sheet.

* * * * *